United States Patent [19]

Rohner

[11] Patent Number: 4,564,147

[45] Date of Patent: Jan. 14, 1986

[54] WINDING MACHINE

[75] Inventor: Joachim Rohner, Monchen-Gladbach, Fed. Rep. of Germany

[73] Assignee: W. Schlafhorst & Co., Monchen-Gladbach, Fed. Rep. of Germany

[21] Appl. No.: 640,087

[22] Filed: Aug. 13, 1984

[30] Foreign Application Priority Data

Aug. 13, 1983 [DE] Fed. Rep. of Germany ..... 3329362

[51] Int. Cl.[4] ..... B65H 54/20; B65H 67/06

[52] U.S. Cl. ..... 242/35.5 A; 198/371; 242/35.5 R

[58] Field of Search ..... 242/35.5 A, 35.5 R, 242/35.6 R; 198/371

[56] References Cited

U.S. PATENT DOCUMENTS

| | | | |
|---|---|---|---|
| 2,177,680 | 10/1939 | Abbott | 242/35.6 R |
| 2,306,871 | 12/1942 | Esser et al. | 242/35.6 R |
| 3,195,298 | 7/1965 | Furst | 242/35.5 R X |
| 3,405,877 | 10/1968 | Jenny | 242/35.5 R |

*Primary Examiner*—Stanley N. Gilreath

*Attorney, Agent, or Firm*—Herbert L. Lerner; Laurence A. Greenberg

[57] ABSTRACT

In a winding machine having a plurality of sequentially disposed winding sections and common end sections, each of the winding sections includes a plurality of winding stations, and a bobbin tube transporter selectively adjustable for clockwise and counterclockwise rotation for discharging empty bobbin tubes, the bobbin tube transporters of all of the winding sections being mutually sequentially aligned.

6 Claims, 1 Drawing Figure

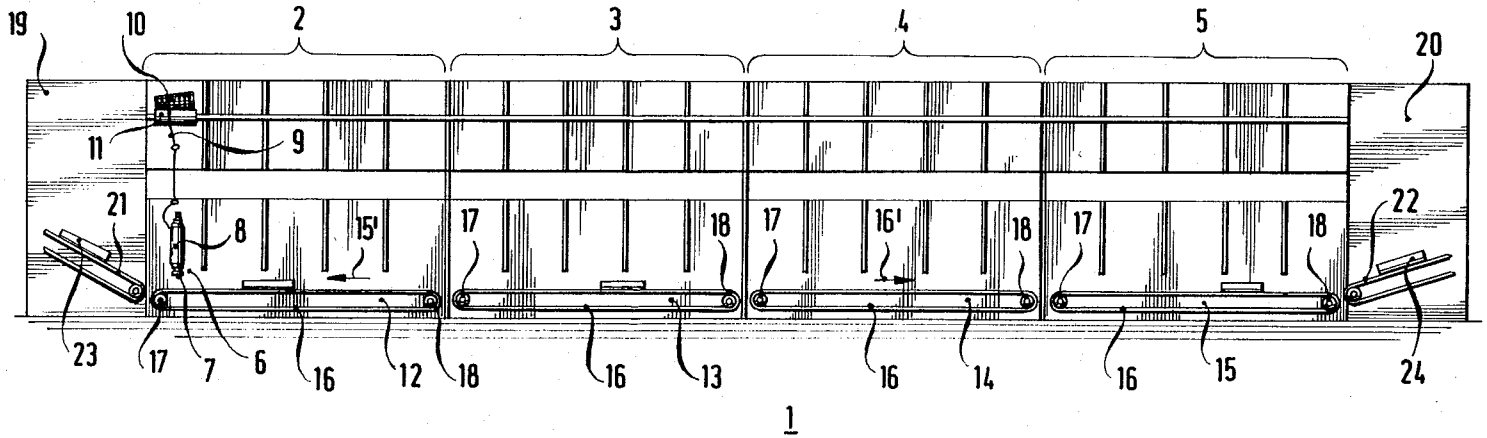
1
2
3
4
5
6
7
8
9
10
11
12
13
14
15
15'
16
16'
17
18
19
20
21
22
23
24

WINDING MACHINE

The invention relates to a winding machine having a plurality of sequentially disposed winding sections with common end sections, each winding section having a plurality of winding stations provided with means for transporting away or discharging empty bobbin tubes.

In winding machines of this type, the bobbin tubes are transported along the sides of the machine, and are deposited in boxes, for example, at the end of the machine.

If the winding machine is only formed of a few sections, and each section only has a few winding stations, the removal of the bobbin tubes present no difficulty. However, economic reasons make it necessary to combine the winding machine into larger structural units, so that, for examples, each station has ten winding stations, and the whole winding machine has five or more sections, for example.

Even if only one batch is produced at the winding machine, the great number of winding stations makes it necessary to deposit the bobbin tubes at both sides of the machine near the end frames or sections. However, this is only made possible by installing two transport systems for the removal of the empty bobbin tubes, which are completely separated from each other. If only a single batch is run, there is still no great difficulty. However, problems concerning the transportation of the bobbin tubes do arise when two different job lots or batches are to be produced, with bobbin tubes having varied shapes. A rigid spool removal transport system drastically limits the possibility of running two different batches on the same winding machine. Either the two batches have to be run one after the other, or smaller lots are used, in which case whole sections are not used at all.

It is accordingly an object of the invention to provided a winding machine which overcomes the hereinafore-mentioned disadvantages of the heretofore-known devices of this general type, and to permit the simultaneous running of one or two batches if so desired in a high efficiency winding machine, in which the number of sections assigned to the individual batches can be freely chosen from case to case.

With the foregoing and other objects in view there is provided, in accordance with the invention, a winding machine having a plurality of sequentially or serially disposed winding sections and common end sections, each of the winding sections comprising a plurality of winding or spooling stations, and a bobbin tube transporter selectively adjustable for clockwise and counterclockwise rotation for discharging empty bobbin tubes, the bobbin tube transporters of all of the winding sections being mutually sequentially or serially aligned. For example, if a first batch is to be run at the first section of a winding machine and a different batch at the remaining sections, the bobbin tube transport of the first section is set to rotate counterclockwise, while all of the other bobbin tube transporters are set to rotate in a clockwise direction. Accordingly, the direction motion of the bobbin tube transporters changes exactly at the point where the batches are separated in the machine. The separating point of the batches lies exactly at the separating point of the sections. It is accordingly possible to change the transport direction of the bobbin tube removal by choice at each separation point of the various sections, a feature which was not available heretofore.

In accordance with another feature of the invention, the bobbin tube transporters are flat bed or belt conveyors.

In accordance with a further feature of the invention, each of the bobbin tube transporters includes its own drive means adjustable for clockwise and counterclockwise rotation.

In accordance with an additional feature of the invention, each of the bobbin tube transporters is an endless conveyor belt having a guide roller at one end thereof and a drive roller at the other end thereof being selectively adjustable for clockwise and counterclockwise rotation. In this way, the belt is either set in motion in one direction by pulling at the upper part of the belt, or in the other direction by pulling at the lower part of the belt, In accordance with a concomitant feature of the invention, each of the bobbin tube transporters is an endless conveyor belt having a first drive roller at one end thereof and a second drive roller at the other end thereof, the rollers of each of the conveyor belts being alternatingly adjustable between a first setting wherein the first roller rotates clockwise and the second roller is idling, and a second setting wherein the first roller is idling and the second roller rotates counterclockwise. This is advantageous especially with longer sections. In this manner, the endless transport belt is always set in motion by pulling at the upper portion of the belt. For example, the drive rollers can be combined with an electrical motor thus forming a belt diving unit.

Other features which are considered as characteristic for the invention are set forth in the appended claims.

Although the invention is illustrated and described herein as embodied in a winding machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which the single FIGURE of the drawing is a diagrammatic front-elevational view of the winding machine of the invention.

Referring now to the FIGURE of the drawing in detail, there is seen a winding machine which is designated with reference numeral 1 as a whole, and which is exclusively formed of four sequentially disposed sections or winding sections 2 to 5. Each section is merely formed of five similarly constructed winding stations. Out of all of the stations, only station 6 of section 2 includes additional details, such as a creel spool 8 mounted on a bobbin tube 7 and having a thread 9 wound onto a creel bobbin 10. The bobbin 10 is driven by friction by means of a winding or batching roller 11.

Each section is provided with a bobbin tube transporting device having the capability of being set by choice to move either clockwise or counterclockwise. The section 2 has a bobbin tube transporter or conveyor 12, section 3 has a bobbin tube transporter 13, section 4 has a bobbin tube transporter 14, and section 5 has a bobbin tube transporter 15. All of the bobbin tube transporters 12 to 15 are similarly constructed. The transporters are in alignment with each other, and are constructed in the form of flat bed type conveyors.

The bobbin tube transporter 12 is used as an example, and shows that each bobbin tube transporter includes an endless transport belt 16 which has a drive roller 17, 18 at each end. Alternatingly, one of the rollers can be set for clockwise operation while the other one runs free of idles, or the first one may be set for free running or idling and the other one for counterclockwise operation.

A ramp 21 is disposed directly in front of the left end section 19 of the winding machine 1 and ends above a non-illustrated tube collector. A ramp 22 is also provided at the right end section 20 of the winding machine 1, directly in front of the bobbin tube transporter 15. The ramp 20 also terminates above a non-illustrated tube collector.

It is now assumed that one batch or job lot is run on the section 2 and another batch is produced on the sections 3 to 5. In order to accomplish this without difficulty, both ramps 21 and 22 are placed in operation for collecting conical bobbin tubes 23 of the first batch, and cylindrical bobbin tubes 24 of the other batch. The drive roller 17 of the bobbin tube transporter 12 rotates counterclockwise, and the roller 18 of the same bobbin tube transporter is set for free running. The bobbin tubes are transported in the direction of the arrow 15'.

In the bobbin tube transporters of the remaining sections 3, 4 and 5, the respective rollers 18 are set for clockwise driving and the rollers 17 are set for free-running. In this case the bobbin tubes are transported in the direction of the arrow 16'.

Besides the above-mentioned advantages, the invention also provides the advantage of permitting the number of sections to be increased or decreased without difficulty. Each section including the bobbin tube transporter forms a system which is independent of the other sections to a great degree.

The invention is not limited to the illustrated and described specific embodiment which is used as an example.

There are claimed:

1. In a winding machine having a plurality of sequentially disposed winding sections and end sections, each of said winding sections comprising a plurality of winding stations, and a plurality of separate bobbin tube transporters each being disposed at a respective one of said winding sections and each having a bobbin supporting surface being selectively adjustable for movement in opposite directions for discharging empty bobbin tubes from said winding sections to said end sections, said bobbin tube transporters of all of said winding sections being mutually sequentially aligned.

2. Winding machine according to claim 1, wherein said bobbin tube transporters are flat conveyors.

3. Winding machine according to claim 1, wherein each of said bobbin tube transporters includes its own drive means adjustable for clockwise and counterclockwise rotation.

4. Winding machine according to claim 2, wherein each of said bobbin tube transporters includes its own drive means adjustable for clockwise and counterclockwise rotation.

5. Winding machine according to claim 1, wherein each of said bobbin tube transporters is an endless conveyor belt having a guide roller at one end thereof and a drive roller at the other end thereof being selectively adjustable for clockwise and counterclockwise rotation.

6. Winding machine according to claim 1, wherein each of said bobbin tube transporters is an endless conveyor belt having a first drive roller at one end thereof and a second drive roller at the other end thereof, said rollers of each of said conveyor belts being alternatingly adjustable between a first setting wherein said first roller rotates clockwise and said second roller is idling, and a second setting wherein said first roller is idling and said second roller rotates counterclockwise.

* * * * *